US005119613A

United States Patent [19]

Atkinson et al.

[11] Patent Number: 5,119,613

[45] Date of Patent: Jun. 9, 1992

[54] COMPOSITE BEAM, CONNECTOR AND CONSTRUCTION

[75] Inventors: Paul E. Atkinson; Jonathan R. Laws, both of Leicester, England

[73] Assignee: Owen Brown Group Ltd.

[21] Appl. No.: 495,092

[22] Filed: Mar. 19, 1990

[30] Foreign Application Priority Data

Mar. 21, 1989 [GB] United Kingdom ..... 8906458
Mar. 21, 1989 [GB] United Kingdom ..... 8906459

[51] Int. Cl.[5] ..... E04H 12/18; E04H 12/00

[52] U.S. Cl. ..... 52/646; 52/648; 52/637; 52/650; 52/654

[58] Field of Search ..... 52/637, 645, 646, 648, 52/649, 654, 655

[56] References Cited

U.S. PATENT DOCUMENTS

| | | | |
|---|---|---|---|
| 1,174,501 | 3/1916 | Hughes et al. | 52/654 |
| 1,939,598 | 12/1933 | Ragsdale | 52/654 |
| 4,065,890 | 1/1978 | Fenner | 52/648 |
| 4,516,375 | 5/1985 | Pagano et al. | 52/650 |
| 4,562,681 | 1/1986 | Smith | 52/646 |
| 4,620,405 | 11/1986 | Melland | 52/648 |
| 4,633,566 | 1/1987 | Coppa | 52/646 |
| 4,922,669 | 5/1990 | DePas et al. | 52/648 |

*Primary Examiner*—Neill R. Wilson
*Attorney, Agent, or Firm*—Longacre & White

[57] ABSTRACT

A composite beam, pillar or truss comprises polygonal cross-section modular units 11 connected end to end with adjacent units 11 reversed, the units 11 being held together by stringers 12 and end caps 13, and the whole beam being pre-tensioned by tie rods 21 passing through the stringers 12 or by threaded inserts. A connector 110 of cube form comprises face plates 111 having screw threaded connectors for the beams, the face plates being held together by a plurality of internal corners 113 and external corners 114. The beam 10 and connector 110 are apertured to receive services from any direction and can be assembled to form a pre-fabricated building or other structure.

10 Claims, 7 Drawing Sheets

COMPOSITE BEAM, CONNECTOR AND CONSTRUCTION

BACKGROUND OF THE INVENTION

1. Field of the invention

This invention relates to a composite beam, pillar or truss, to a connector therefor, and to a construction incorporating such beams.

The invention is particularly concerned with the construction of prefabricated large-scale temporary buildings such as exhibition halls, but also with structures which are not themselves buildings , for example the construction of lighting rigs.

A composite beam, pillar or truss will hereinafter be called a "beam" for convenience. It is desirable to be able to provide structures such as those listed in a variety of shapes and sizes by the use of modular construction for the beams and pillars so that only a small number of standard types of part are needed in stock.

2. Summary of the invention

It is an object of a first aspect of the invention to provide a new or improved composite beam (as defined).

According to this aspect of the invention, there is provided a composite beam comprising a plurality of modular units, each unit having identical corner formations, the units being disposed end to end to define the length of a beam;

a plurality of elongate stringers adapted to have a keyed engagement with said corner formations to connect the units together; and a pair of end caps adapted to be secured to the stringers at respective ends of the beam.

The units may be of polygonal outline and are preferably square.

Each unit may comprise a space-frame of pyramidal form comprising a plurality of struts, equi-spaced about an apertured core and intersecting a polygonal end frame.

Alternatively, each unit may be conical having an apertured core and a polygonal end frame.

The apertured core may have laterally facing and longitudinally facing apertures to permit passage of services into and through the beam. Where the unit is pyramidal, each structure may be of 3 winged, circular or triangular cross-section for rigidity, Alternate units may be inverted when being disposed end to end.

The keyed engagement may be made between grooves of the stringers and projections or ribs of the units. Spacers may be provided between adjacent such projections or ribs to fill the grooves along their entire length.

The end caps may be arranged to bear on the units to exert a compressive pre-tension on the beam.

Tie rods passed through the stringers may be connected to the end caps to exert said compressive pre-tension, or alternatively threaded inserts may be used to exert pre-tension.

The stringers may be cut to length slightly shorter than the plurality of units to which they are keyed, so that attachment of the end caps may compress the units slightly in length.

Adhesive may be introduced into the grooves after final assembly to lock the beam together.

Since structures built up of beams may vary greatly in size and shape, it is desirable to have connectors for the beams which permit design versatility without the need for stocks of many different components to be kept.

It is therefore an object of a further aspect of the present invention to provide a new or improved connector of modular construction, capable of being connected at some or all of its faces to beams (as defined) of a structure.

According to the invention there is provided a connector for beams, the connector comprising a number of polygonal face members, each face member having connection means capable of connection to a respective beam, the face members being adapted to be connected together into a three-dimensional body having a plurality of corners at each of which three members meet, the connector comprising a corresponding plurality of internal corner members and a corresponding plurality of external corner members adapted to be secured respectively internally and externally of the corners to clamp three face members together at each of the corners.

Preferably, the polygonal face members are generally square and the three-dimensional body is a cube.

Each cube member may have a central aperture whereby services such as cables and pipework can be passed through the connector in any direction.

Each face member may have a screw thread adapted to mate with a thread provided on a beam.

Viewed from a further aspect, the invention provides a construction comprising a plurality of opposite beams as set out above, connected together by means of one or more connectors as set out above.

The construction may comprise a building.

The construction may include a rainwater drainage assembly for a roof, the assembly comprising beams secured together by connectors as set out above, the assembly further comprising a rainwater collector on said roof, a drain pipe extending from said collector to one of said connectors, and a vertical drain extending from said connector to discharge.

BRIEF DESCRIPTION OF THE SEVERAL VIEWS OF THE DRAWINGS

Embodiments of the invention will now be described by way of example only with reference to the accompanying drawings, in which.

DETAILED DESCRIPTION OF PREFERRED EMBODIMENTS

Figure 1:
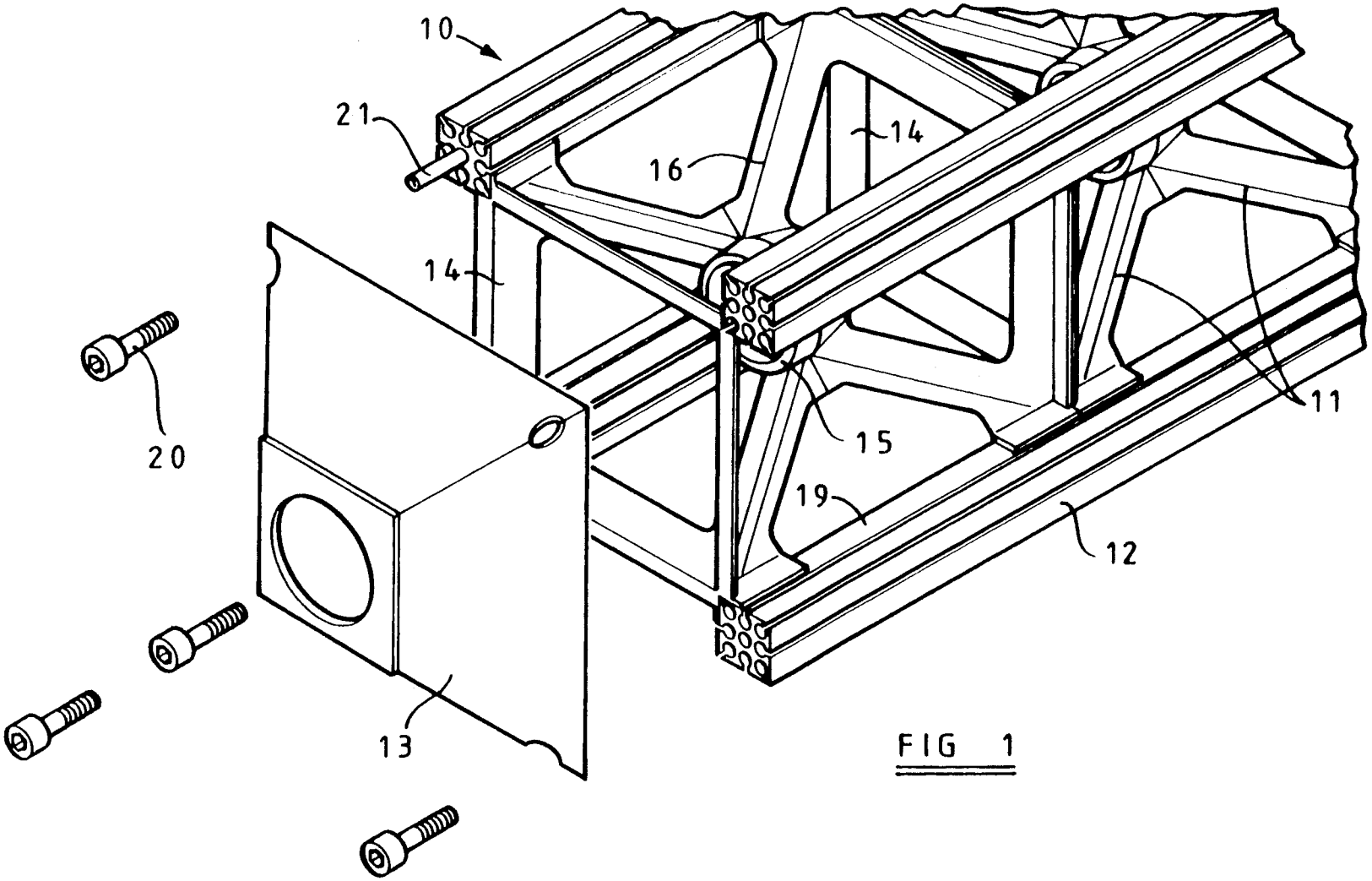
FIG. 1 is a diagrammatic exploded perspective view of an end portion of a beam.
Figure 2:
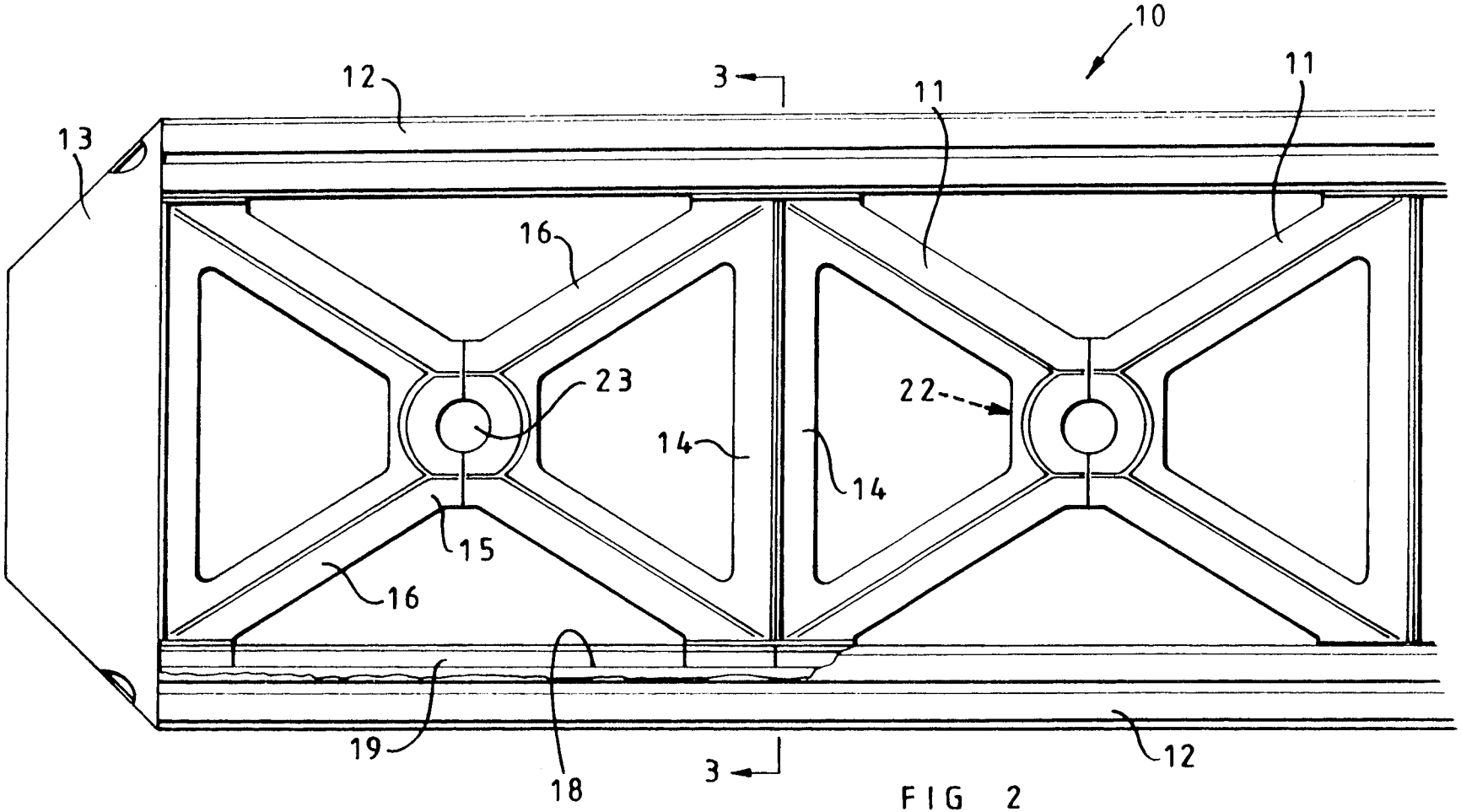
FIG. 2 is a side elevation, on a different scale, as part of the beam.

Referring to the drawings, a beam pillar or truss 10 is made up of a plurality of units 11, a plurality of elongate stringers 12 and a pair of end caps 13, only one of which is shown in FIGS. 1 and 2.

Figure 3:
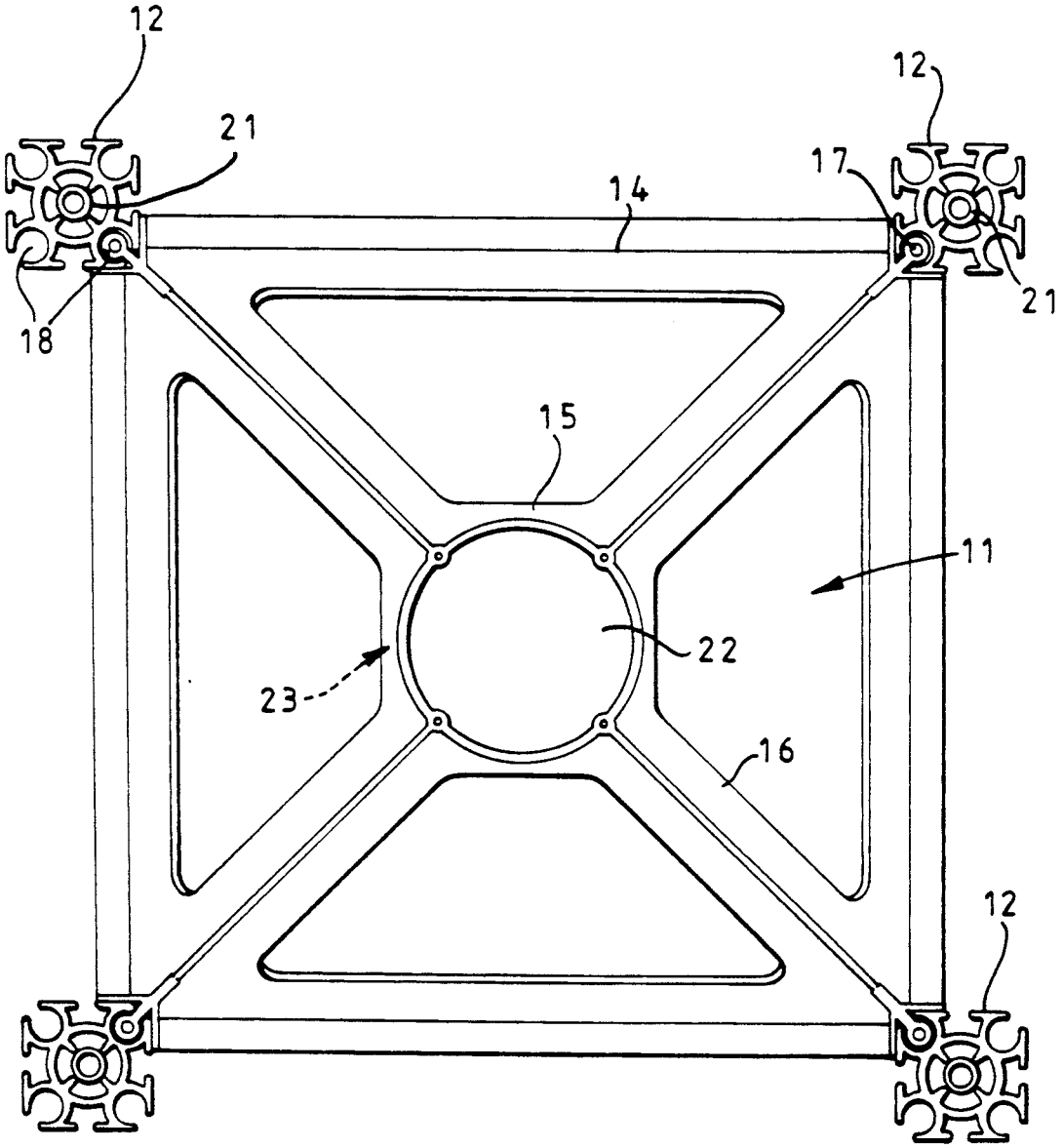
FIG. 3 is a plan sectional view on the line 3—3 of FIG. 2, again on a different scale.

Each unit 11 comprises a pyramidal space-frame having a frame 14 of square outline, a central apertured core 15 and four struts 16 connecting the frame 14 and the core 15. The arrangement is best seen in FIGS. 2 and 3. Although the outline of the unit is square in the example shown, it could be of other polygonal outline, such as triangular, or could be conical.

Each pyramidal unit 11 is assembled next to another in an inverted condition as seen in FIG. 2. The units 11 have corner formations 17, best seen in FIG. 2, which comprise ribs or projections which are slidable in and keyed into elongate grooves 18 of the stringers 12. Spacers 19 are inserted between the corner formations of adjacent units to fill the grooves from end to end of the stringers.

The stringers 12 are cut to the desired length of the beam 10 and assembled with the appropriate number of units 11, which are arranged to project slightly at the ends of the stringers 12. End caps 13 are then attached to the stringers and arranged to bear on the units to exert a compressive pre-tension, to maintain the integrity of the beam in use.

The arrangement of the end caps is best illustrated in FIG. 1, where it will be seen that threaded bolts 20 are passed through the end caps into the stringers. These bolts 20 engage within hollow tie rods, one of which is shown at 21 projecting from the stringer. Each stringer receives a tie rod passing throughout its length and the respective end caps are attached by the bolts 20 at each end of the beam. Tightening of the bolts 20 exerts the required pre-tension on the beam. Alternatively, threaded inserts may be used at the ends of the beam for pre-tensioning.

Pre-tensioning assists in strengthening the composite beam so that it is strong in tension, compression and against flexure. Strength is also ensured by the triangulation within the beam due to the pyramidal shape of the units.

Each strut 16 has good stiffness because of the use of a favourable cross-section. In the example shown, the struts are tri-winged but they could alternatively be circular or triangular in cross-section.

Conical units may be preferred in large-scale application to further increase torsional stiffness.

The units 11 may be made of a suitable glass-filled engineering plastics material by injection moulding. The spacers 19 are of the same material. The stringers 12 are made in extruded aluminium or alloy and cut to length. The tie rods 21 are preferably of steel to give the desired tensile strength for compressive pre-tensioning of the beam. The end caps 13 are die-cast in aluminium alloy.

On assembly of the units 11 with the stringers 12 and end caps 13, the whole assembly is locked together by the injection of adhesive into the grooves 18 of the stringers, through holes (not shown) in the units 11.

The apertured core of each unit is arranged to permit passage of services such as cables and pipeworks into and through the beam. To this end, the core has both a longitudinally facing aperture 22 and laterally facing part apertures 23. These apertures may also provide means for drainage of rainwater falling on a roof supported by a building structure made up of beams as will later be described.

Figure 4:
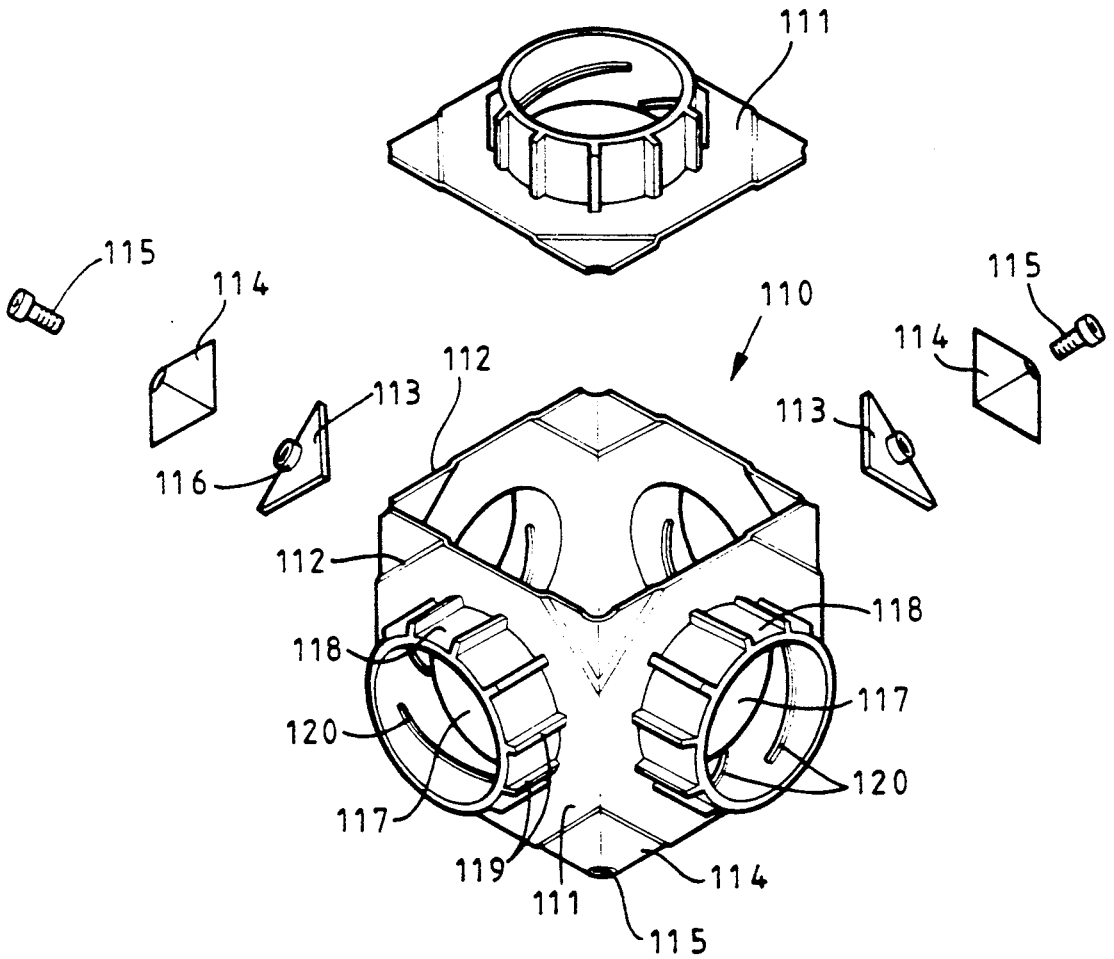
FIG. 4 is an exploded perspective view of a cube-shaped connector embodying the invention.
Figure 5:
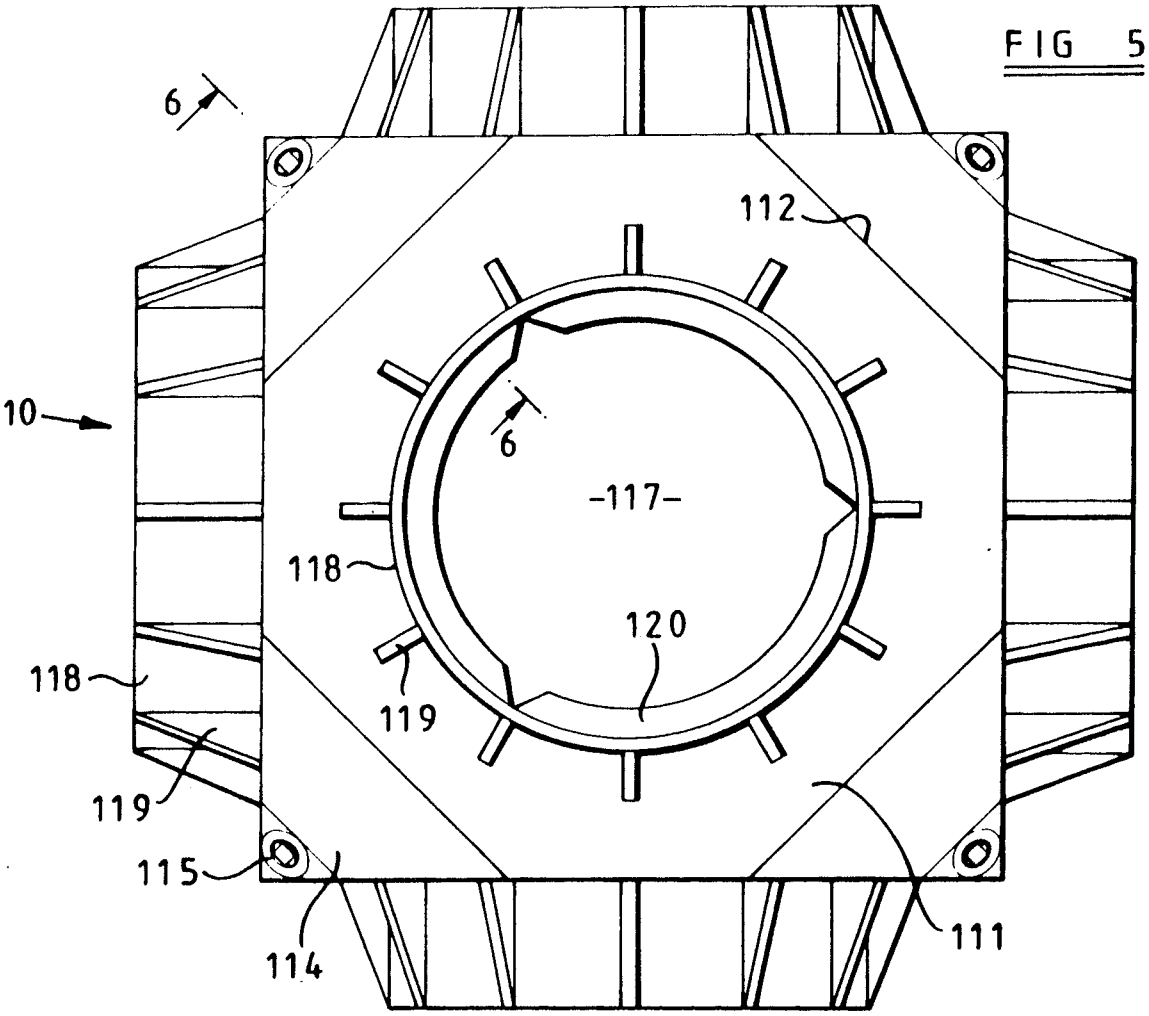
FIG. 5 is a front elevational view of the connector.
Figure 6:
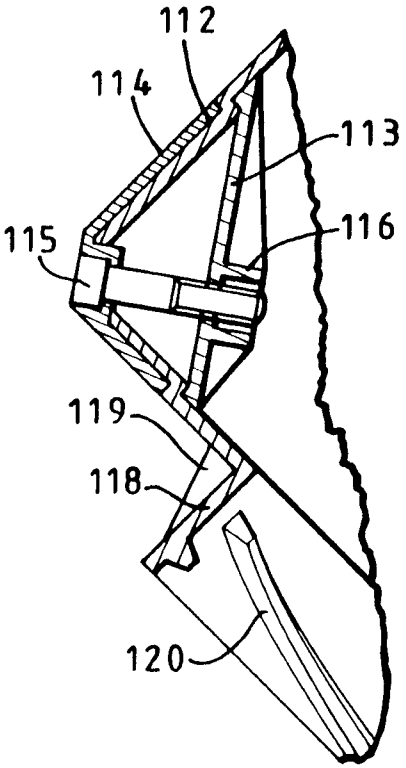
FIG. 6 is a detail section on the line 6—6 of FIG. 5.
Figure 7:
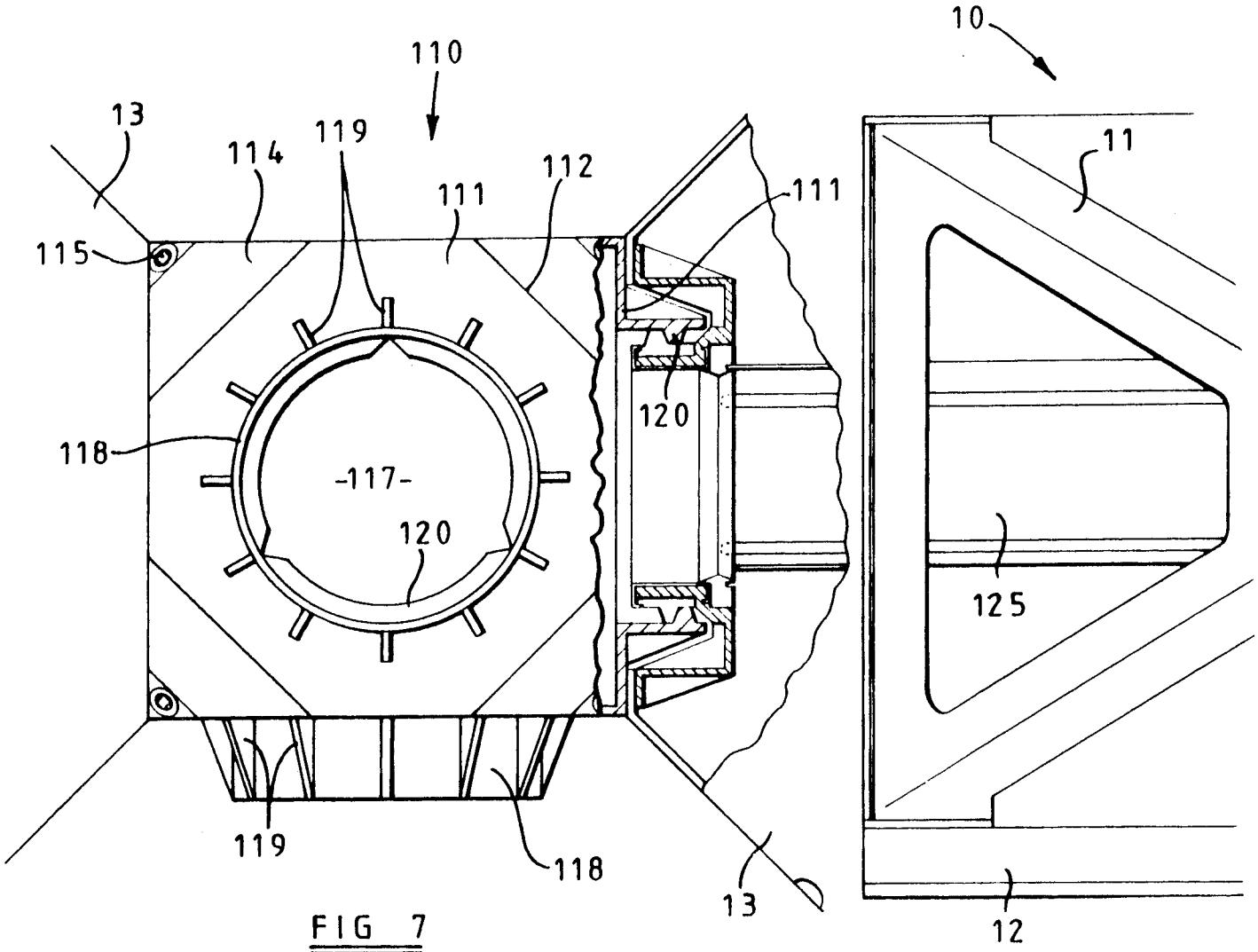
FIG. 7 is a front elevation, partly in section of the connector in use, connected to a beam and having a horizontal pipe such as a drain pipe in place.

The beams described may be used as beams, pillars or trusses, and may be assembled together or to other structures by connection means associated with the end caps. A preferred form of connection means is shown in FIGS. 4 to 6 of the drawings. FIG. 7 shows an assembly of beam and connection means.

Referring firstly to FIGS. 4 and 5 of the drawings, a three-dimensional connector 110 for beams is made up of a number of face members 111, each identical. The connector shown is a cube, made up of six square face members, but other three-dimensional forms could be selected, with appropriately shaped polygonal faces, for example a triangular pyramid having equilateral triangular face members.

The face members each have corner rebates 112. Corner members and fasteners are provided to secure the face members 111 together to form the cube-shaped connector 110. These consist of eight internal corner members 113 and eight external corner members 114. At each corner, three of the face members meet and the internal corner member overlaps the corner rebates 112 of these face members. The external corner member is presented from outside and secured in place by means of a fastener 115 which has a thread mating with an internally threaded bush 116 of the internal corner member 113. Adhesive may be used between the mating surfaces.

FIG. 6 shows the inner and outer corner members 113 and 114 in section, showing the way in which the corner rebates 112 locate the inner and outer corner members 113 and 114, which can then clamp the three face members together.

Each face member has an aperture 117, surrounded by an attachment collar 118 which has tapered fins 119. The collar has an internal screw thread 120 of shallow three-start form for the connection of beams 10 to the connector.

The connection could alternatively be a bayonet-type connection.

FIG. 7 shows the connection of the beam 10. The end caps 13 have a threaded connection with the three-start threads 120 of the connector.

The beam 10, including its end cap 13, has a central through opening. Additionally, lateral openings are provided in the units 11. Through these openings, services such as cables and pipework can be passed into the connector 110, and from there, into other connected beams in any chosen direction. In FIG. 4, a pipe 125 is shown entering the connector 110 from the beam 10.

Figure 8:
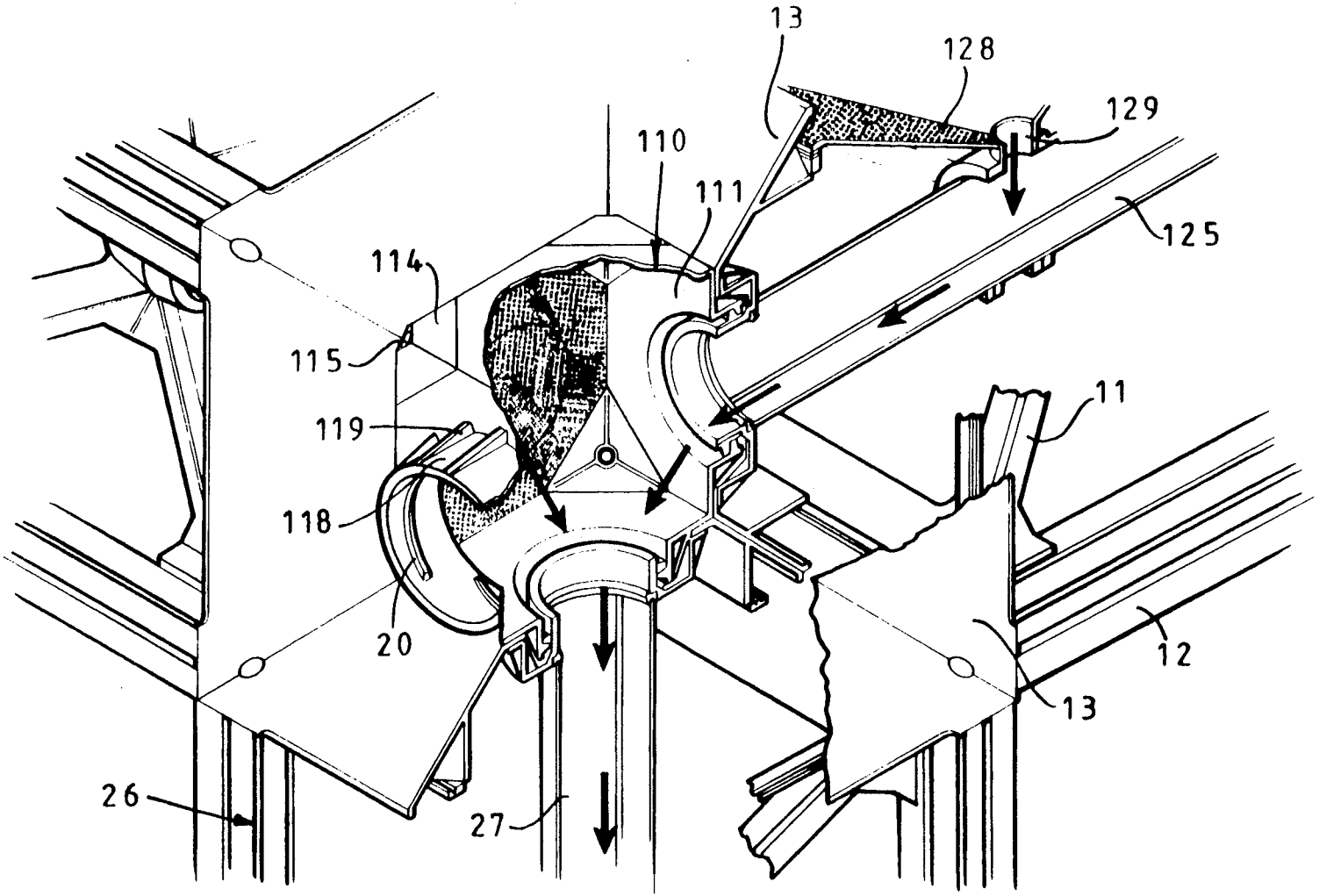
FIG. 8 is a perspective view, partly broken away, of a rainwater drainage system for the roof of a building, including a connector as illustrated in the preceding Figures.

FIG. 8 shows this feature used in a rainwater drainage system for a roof supported by beams and connectors. At the right-hand side of the Figure, the pipe 125 can be seen, entering and discharging into the connector 110. The latter is supported by a lower beam or pillar 126, through which a rainwater downpipe 127 discharges. The pipe 125 is fed from a collector 128 on the roof through a lateral opening 129 communicating with the pipe 125 within the beam.

The connector is made in aluminium or a suitable alloy by die-casting. Its construction requires only a small number of parts, namely the face members, internal and external corner members, which can be assembled as described to produce a connector. The screw connection for attachment of the beams makes for easy assembly of the building structure with consistent accuracy of positioning of the beams. Because of the aperture in each face member, drainage systems and services such as cables can be fed through the beams and connectors in a secure and tidy manner, not obstructing the interior of the building.

We claim:

1. A composite beam comprising a plurality of modular units, each unit having identical corner formations, the units being disposed end to end to define the length of a beam;

a plurality of elongate stringers adapted to have a keyed engagement with said corner formations to connect the units together;

and a pair of end caps adapted to be secured to the stringers at respective ends of the beam.

2. A beam according to claim 1 wherein each unit comprises a space-frame of pyramidal form comprising a plurality of struts, equi-spaced about an apertured core and intersecting a polygonal end frame.

3. A beam according to claim 2 wherein the apertured core has laterally facing and longitudinally facing apertures to permit passage of service elements into and through the beam.

4. A beam according to claim 1 wherein alternate units are inverted when being disposed end to end.

5. A beam according to claim 1 wherein the end caps are arranged to bear on the units to exert a compressive pre-tension on the beam by means of tie rods which pass through the stringers and which are connected to the end caps to exert said compressive pre-tension, or by means of threaded inserts.

6. A connector for beams, the connector comprising a number of polygonal face members, each face member having connection means capable of connection to a respective beam, the face members being adapted to be connected together into a three-dimensional body having a plurality of corners at each of which three members meet, the connector comprising a corresponding plurality of internal corner members and a corresponding plurality of external corner members adapted to be secured respectively internally and externally of the corners to clamp three face members together at each of the corners.

7. A connector according to claim 6 wherein the polygonal face members are generally square and the three-dimensional body is a cube.

8. A connector according to claim 6 wherein each face member has a central aperture whereby service elements such as cables and pipework can be passed through the connector in any direction.

9. A plurality of composite beams wherein each composite beam comprises a plurality of modular units, each unit having identical corner formations, the units being disposed end to end to define the length of a beam, a plurality of elongated stringers adapted to have a keyed engagement with said corner formations to connect the units together, and a pair of end caps adapted to be secured to the stringers at respective ends of the beam; said plurality of composite beams being connected together by at least one connector to form a construction, each of said connectors comprising a number of polygonal face members, each face member having connection means connected to a respective one of said composite beams, each face member being connected to other of said face members to form a three dimensional body having a plurality of corners at which three of said face members meet, said connector also comprising a plurality of internal corner members and a corresponding plurality of external corner members secured respectively internally and externally of said corners to clamp three of said face members together at each of said corners.

10. A plurality of composite beams according to claim 9 wherein each face member of the connector has a screw thread, each end cap of each beam has a screw thread and the beams are threadedly secured to the face members of the connector.

* * * * *